United States Patent [19]

Riedinger, Jr. et al.

[11] 4,163,575

[45] Aug. 7, 1979

[54] CORNSCREW

[76] Inventors: Larry P. Riedinger, Jr., c/o Geo. Spector, 3615 Woolworth Bldg., 233 Broadway; George Spector, 3615 Woolworth Bldg., 233 Broadway, both of New York, N.Y. 10007

[21] Appl. No.: 828,775

[22] Filed: Aug. 29, 1977

[51] Int. Cl.[2] ..... A47G 21/00

[52] U.S. Cl. ..... 294/5

[58] Field of Search ..... 294/5, 61; D7/42; 81/3.1 A, 3.38 A, 3.45

[56] References Cited

U.S. PATENT DOCUMENTS

| | | | |
|---|---|---|---|
| D. 39,815 | 2/1909 | Bomeisler | D7/42 |
| 190,669 | 5/1877 | Crannell | 81/3.1 A |
| 196,761 | 11/1877 | Oak | 81/3.1 A |
| 201,230 | 3/1878 | de Yongh | 294/5 |
| 561,016 | 5/1896 | Maud | 81/3.1 A |
| 587,339 | 8/1897 | Stebbins | 294/5 |
| 701,791 | 6/1902 | Andros | 81/3.1 A |
| 860,138 | 7/1907 | Johnson | 81/3.38 A |

*Primary Examiner*—Johnny D. Cherry

[57] ABSTRACT

A pair of handles mountable at opposite ends of an ear of corn so that the ear can be easily held in the hands when hot so a person can eat corn "on the cob"; each handle including a small knob in the shape of an ear of corn, each knob having a screw affixed on its one end for screwing into the ear of the ear cob for rigid attachment.

2 Claims, 4 Drawing Figures

CORNSCREW

This invention relates generally to corn ear holders.

It is generally well known that many persons enjoy eating corn "on the cob", by holding the corn ear in the hands while the corn kennels are bitten off therefrom. When the corn is thus eaten, it must be hot, having been just removed from a pot of boiling water so that the ear is usually too hot for being comfortably held in the hands. Accordingly, a number of ear corn holders have heretofore been designed for attachment to opposite ends of the ear of corn. However, none of these holders have proved to be ideal because they each comprise a knob mounted either on a spike or blade which is usually difficult to insert into the corn cob end because the cob is hard and is difficult to handle for the insertion while being very hot. This situation accordingly warrants improvement.

Therefore is is a principal object of the present invention to provide a holder which is easily securable to the cob by screwing thereinto, so that it does not require a great force for invention such as is difficult to apply by persons who do not have great strength, such as children, women or those who are older.

Another object is to provide a holder which cannot accidently fall out of the cob such as sometimes occur with holders having spikes or blades which easily can slide out of the cob.

Other objects are to provide big Larry's cornscrew which is simple in design, inexpensive to manufacture, rugged in construction, easy to use and efficient in operation.

These and other objects will be readily evident upon a study of the following specifications and the accompanying drawing wherein.

Figure 1:
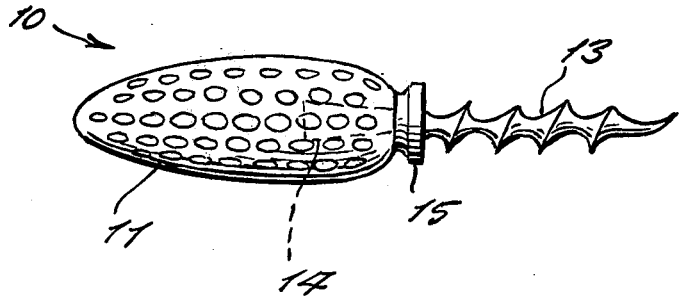
FIG. 1 is a side view of the invention
Figure 2:
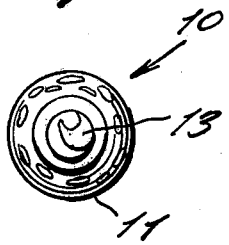
FIG. 2 is an end view thereof.
Figure 3:
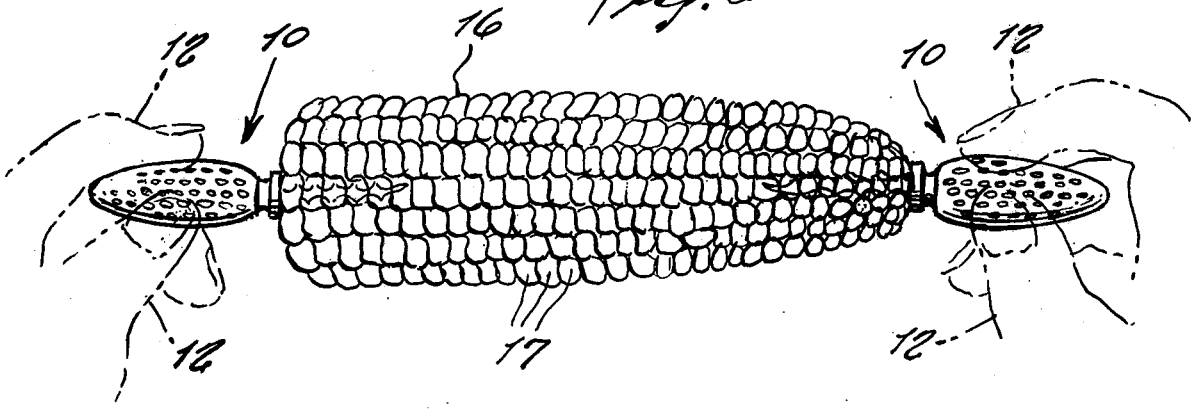
FIG. 3 show two of the invention cornscrew secured to opposite ends of a cob of corn so to conveniently allow holding the hot corn while biting the kennels thereof.

Referring now to the drawing in greater detail, and more particularly to FIGS. 1 to 3 thereof at this time, the reference numeral 10 represents a cornscrew according to the present invention wherein there is a knob 11 of a size and shape so that it can be conveniently held between fingers 12 of a hand. The knob preferably made of molded plastic, is shaped like an ear of corn and its surface is textured so to resemble rows of corn kennels.

A screw 13 protrudes from one end of the knob and has a thread that resembles some bottle corkscrews. The screw is made of metal, and a base 14 thereof is molded inside the knob. A ferrule 15 adjacent the knob end may be integrally formed on the outer end of the base.

In use, a corn screw 10 is screwed in each end of an ear of corn 16 so a person can hold the knobs with both hands while biting the corn kennels 17 of the ear cob.

Figure 4:
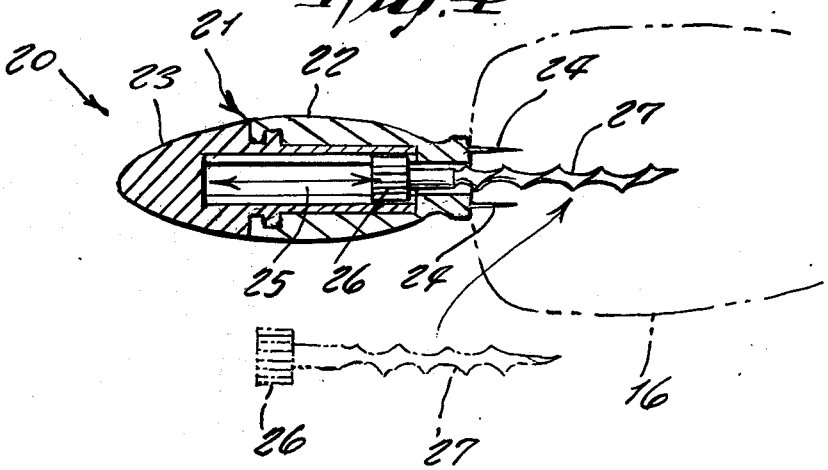
FIG. 4 shows a modified design of the invention in which additionally two sharp prongs are first pierced into the corn cob so to temporarily hold the cornscrew firmly thereto while the screw is being screwed into the cob, in order to eliminate the need to hold the hot cob by a hand during their operation.

In FIG. 4, a modified design of cornscrew 20 is designated for easy securement to the cob, and accordingly, includes a knob 21 divided into an axially movable member 22 and a rotatable member 23 supported thereupon. The member 22 includes short prongs 24 that can be pierced into the cob a short distance. The rotatable member has a splined central hole 25 in which a toothed head 26 is slidable, the head being integral with a screw 27.

In a fully retracted position, the screw protrudes outwardly of the knob only enough so a start of a spiral thread thereof engages the cob.

In use the cornscrew is jabbed against the cob so the prongs 24 and start of the screw 27 engage the cob. This is quickly done so a person needs not to continue thereafter to hold the hot ear of corn during the installation. Instead a person holding member 22 rigidly with one hand, then rotates the member 23 so to cause the screw to turn and thus advance axially into the cob for a firm hold thereof. After use, it is simply unscrewed.

While various changes may be made in the detail construction, it is understood that such changes will be within the spirit and scope of the present invention as in defined by the appended claims.

What is claimed is:

1. A device for holding corn for eating purposes comprising a knob having an outer surface of cornlike appearance and an inner end with prongs extending therefrom for piercing the end of an ear of corn in combination with a screw mounted in an axial opening in said knob, said screw being axially and rotatably movable relative to said knob and extending axially outward of said opening, in combination with means mounted on said knob engaging said screw for rotating and moving said screw axially relative to said knob opening.

2. A device as in claim 1, wherein said screw includes a toothed head at one end and said means comprises a knob head having an outer surface contiguous with and similar to the knob providing a continuous outer surface similar to an ear of corn, said knob head including an elongated chamber with splines enclosing said toothed head, said knob head being rotatably mounted on said knob whereby rotation of said knob head causes said splines to engage the toothed head and rotate the screw.

* * * * *